US010807785B2

(12) United States Patent
Pan et al.

(10) Patent No.: US 10,807,785 B2
(45) Date of Patent: Oct. 20, 2020

(54) PACKAGING TRAY STRUCTURE AND SUBSTRATE PACKAGING STRUCTURE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Jianwei Pan, Beijing (CN); Lichuan Xiao, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 354 days.

(21) Appl. No.: 15/745,654

(22) PCT Filed: Jun. 26, 2017

(86) PCT No.: PCT/CN2017/090014
§ 371 (c)(1),
(2) Date: Jan. 17, 2018

(87) PCT Pub. No.: WO2018/099054
PCT Pub. Date: Jun. 7, 2018

(65) Prior Publication Data

US 2020/0087046 A1 Mar. 19, 2020

(30) Foreign Application Priority Data

Nov. 30, 2016 (CN) ..... 2016 2 1301739 U

(51) Int. Cl.
*H01L 21/673* (2006.01)
*B65D 81/133* (2006.01)
(Continued)

(52) U.S. Cl.
CPC ..... *B65D 81/133* (2013.01); *B65D 77/26* (2013.01); *B65D 85/30* (2013.01)

(58) Field of Classification Search
CPC ..... B65D 81/133; B65D 77/26; B65D 85/48; H01L 21/67346; H01L 21/673
(Continued)

(56) References Cited

U.S. PATENT DOCUMENTS 7,261,207 B2 8/2007 Suzuki et al.
2009/0297303 A1* 12/2009 Hyobu ..... H01L 21/67346 414/269

FOREIGN PATENT DOCUMENTS

CN 201566966 U 9/2010
CN 202201243 U 4/2012
(Continued)

OTHER PUBLICATIONS

International search report dated Sep. 30, 2017 for corresponding application No. PCT/CN2017/090014 with English translation attached.

*Primary Examiner* — King M Chu
(74) *Attorney, Agent, or Firm* — Nath, Goldberg & Meyer; Joshua B. Goldberg

(57) ABSTRACT

Disclosed are a packaging tray structure and a substrate packaging structure. The packaging tray structure comprises a first tray including a first surface and a recess formed on the first surface for placing a to-be-packaged object; a second tray stacked on the first surface and cooperating with the first tray; a protective gasket disposed between the first tray and the second tray; and a limiting portion provided on at least one of the first tray and the second tray for limiting shift of a protective gasket. The limiting portion supports the protective gasket in such a manner that a gap is maintained between the protective gasket and the to-be-packaged object.

20 Claims, 3 Drawing Sheets

(51) Int. Cl.
*B65D 77/26* (2006.01)
*B65D 85/30* (2006.01)

(58) Field of Classification Search
USPC ..... 206/454
See application file for complete search history.

(56) References Cited

FOREIGN PATENT DOCUMENTS

| | | | |
|---|---|---|---|
| CN | 204624126 | U | 9/2015 |
| CN | 206203064 | U | 5/2017 |
| JP | H05139475 | A | 6/1993 |

* cited by examiner

PACKAGING TRAY STRUCTURE AND SUBSTRATE PACKAGING STRUCTURE

CROSS-REFERENCE TO RELATED APPLICATION

This is a National Phase Application filed under 35 U.S.C. 371 as a national stage of PCT/CN2017/090014, filed Jun. 26, 2017, This application claiming the benefit of China Patent Application No. 201621301739.7, filed in China on Nov. 30, 2016, the entire contents of which are hereby incorporated by reference.

FIELD

The present disclosure relates to the field of display technologies, and in particular, to a packaging tray structure and a substrate packaging structure.

BACKGROUND

Currently, in the field of liquid crystal manufacturing, liquid crystal screens are usually stored in a packaging tray structure (Tray) during transportation of the liquid crystal screens in the industry. However, in the transportation process, the protective gasket inside the tray structure rubs against a surface of the LCD screen, tending to damage a circuit on the surface of the LCD screen. Further, in long-term storage and high temperature environment (more than 50° C., in summer it is easy to reach this temperature in a container), the material of the protective gasket is inclined to ooze oil to contaminate the surface of the LCD screen.

SUMMARY

The technical solutions according to the disclosure are as follows.

The disclosure provides a tray structure, wherein the tray structure comprises:

a first tray including a first surface and a recess formed on the first surface for placing a to-be-packaged object;

a second tray stacked on the first surface and cooperating with the first tray; and a limiting portion provided on at least one of the first tray and the second tray, for limiting shift of a protective gasket, wherein the limiting portion is configured to support the protective gasket in such a manner that a gap is maintained between the protective gasket and the to-be-packaged object.

Further, the recess has a first supporting surface for supporting the to-be-packaged object therein; and the limiting portion comprises a supporting platform disposed on the first surface of the first tray, and the supporting platform is configured to surround the recess and has a second supporting surface for supporting the protective gasket, wherein the first supporting surface has a first height in a direction perpendicular to a bottom of the recess, the second supporting surface has a second height in the direction perpendicular to the bottom of the recess, and the second height is greater than the first height.

Further, a difference between the second height and the first height is greater than or equal to a sum of a thickness of the to-be-packaged object and a width of the gap.

Further, the width of the gap ranges from 1 mm to 2 mm.

Further, the packaging tray structure comprises a fixing portion provided between the first tray and the second tray to fix the protective gasket.

Further, the second tray includes a second surface facing the first tray; and the fixing portion includes a raised pressure platform protruding from the second surface, the raised pressure platform being disposed in a position corresponding to the periphery of the recess so as to press and fix the protective gasket against the first tray.

Further, the protective gasket is provided with a plurality of openings in a region corresponding to the periphery of the recess; and the fixing portion includes a plurality of fixing columns protruding from the first surface of the first tray and inserted into the openings.

Further, the fixing column includes a first end connected to the first tray and a second end opposite to the first end, wherein an outer diameter of the fixing column gradually decreases from the first end to the second end.

Further, the fixing column has a cross section in a circular, triangular or square shape.

Further, a plurality of recesses are formed on the first surface of the first tray, the protective gasket is an integral sheet-like structure covering all the recesses, and the limiting portion is disposed on the periphery of each of the recesses.

The disclosure also provides a packaging structure for packaging a substrate, wherein the packaging structure comprises:

a tray structure for packaging the substrate, wherein the tray structure comprises:

a first tray including a first surface and a recess formed on the first surface for placing a to-be-packaged object, the to-be-packaged object being considered as the substrate;

a second tray facing the first surface and cooperating with the first tray;

a protective gasket disposed between the first tray and the second tray; and a limiting portion provided on at least one of the first tray and the second tray, for limiting shift of a protective gasket, wherein the limiting portion supports the protective gasket in such a manner that a gap is maintained between the protective gasket and the to-be-packaged object.

The disclosure also provides a packaging structure, wherein the packaging structure includes the tray structure as set forth, and the protective gasket is disposed between the first tray and the second tray.

DETAILED DESCRIPTION OF THE EMBODIMENTS

Figure 1:
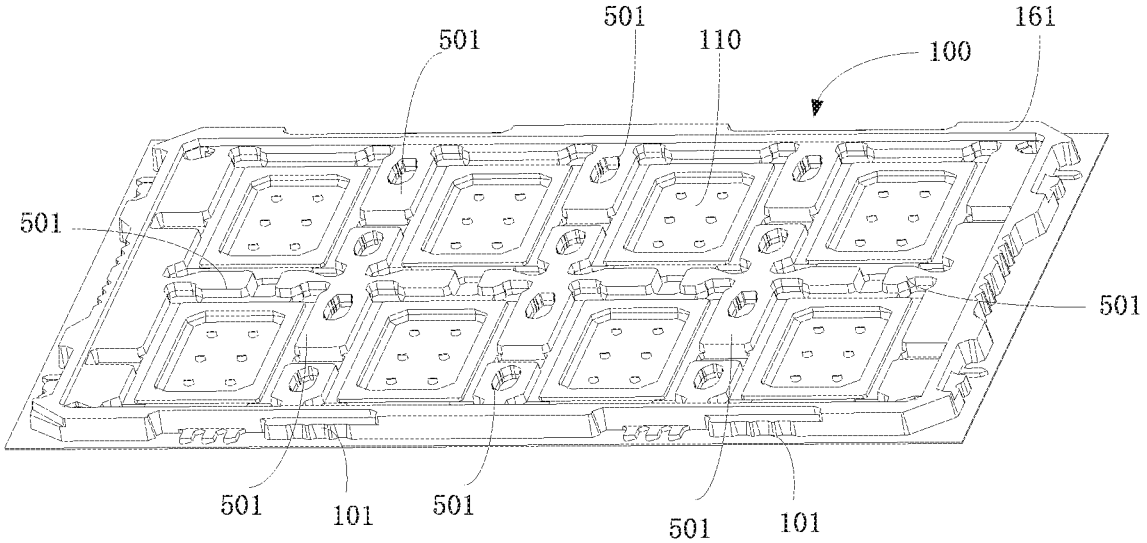
FIG. 1 shows a schematic structural diagram of a first tray of a packaging tray structure according to an embodiment of the present disclosure.

In order to more clearly understand the objectives, technical solutions and advantages of the embodiments of the present disclosure, the technical solutions of the embodiments of the present disclosure will be clearly and completely described in the following with reference to the accompanying drawings in the embodiments of the present disclosure. Obviously, the embodiments as described herein are only a part but not all of the embodiments of the present disclosure. All other embodiments obtained by an ordinary person skilled in the related art based on the embodiments of the present disclosure as described herein should fall within the protection scope of the present disclosure.

In the packaging tray structure of the related art, when a LCD screen is packaged, a protective gasket may be come into contact with the LCD screen to cause contamination or damage to the LCD screen. The present disclosure provides a packaging tray structure that can significantly improve the protective ability of packaging to address the problems caused by the contact of the protective gasket with an object to be packaged.

As shown in FIG. 1 to FIG. 4, the packaging tray structure according to the present disclosure comprises a first tray 100 and a second tray 200 that are stacked together and mutually cooperate, the first tray 100 and the second tray 200 being configured to receive a to-be-packaged object 300 and a protective gasket 400 therebetween, wherein the first tray 100 includes a first surface 161 facing the second tray 200, a recess 110 is formed on the first surface 161 to receive the to-be-packaged object 300, and the protective gasket 400 is disposed between the to-be-packaged object 300 and the first tray 100; and at least one of the first tray 100 and the second tray 200 is provided with a limiting portion for limiting shift of the protective gasket 400, supporting the protective gasket 400 and maintaining a predetermined gap between the protective gasket 400 and the to-be-packaged object 300.

In the packaging tray structure according to the present disclosure, the to-be-packaged object 300 may be placed within the recess 110 of the first tray 100 and the protection pad 400 may be placed on a side of the to-be-packaged object 300 close to the second tray 200. The first tray 100 and the second tray 200 are snap-fitted together to package the to-be-packaged object 300. In the above manner, since at least one of the first tray 100 and the second tray 200 is provided with the limiting portion which is able to support and limit the protective gasket 400 to maintain a certain gap between the protective gasket 400 and the to-be-packaged object 300, it can be possible to keep away from the problem of contamination or damage to the to-be-packaged object 300 caused by the contact between the protective gasket 400 and the to-be-packaged object 300.

Figure 2:
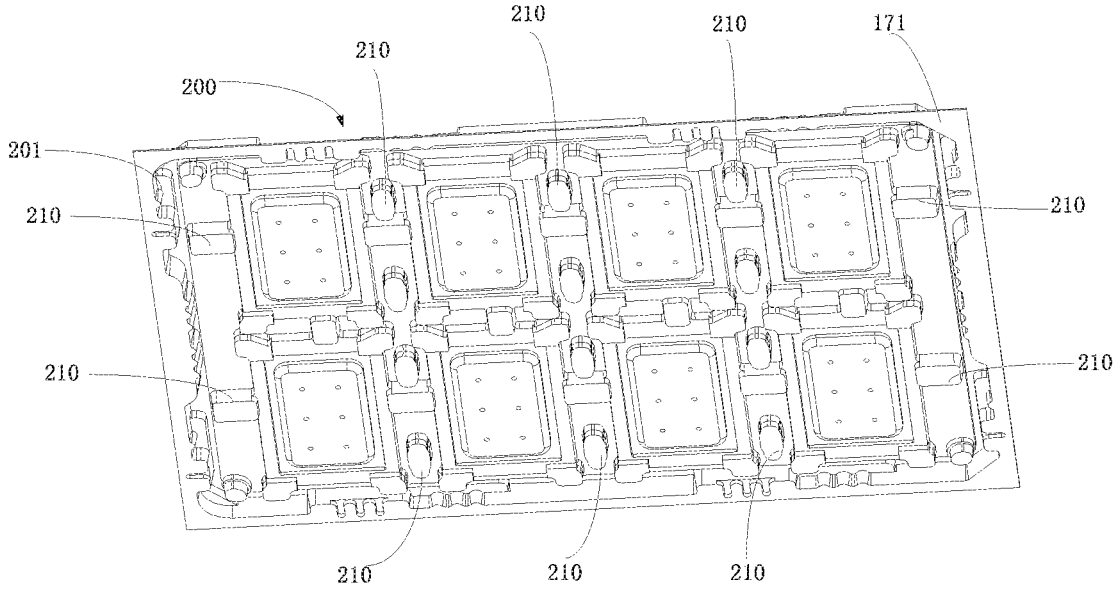
FIG. 2 shows a schematic structural diagram of a second tray of a packaging tray structure according to an embodiment of the present disclosure.
Figure 3:
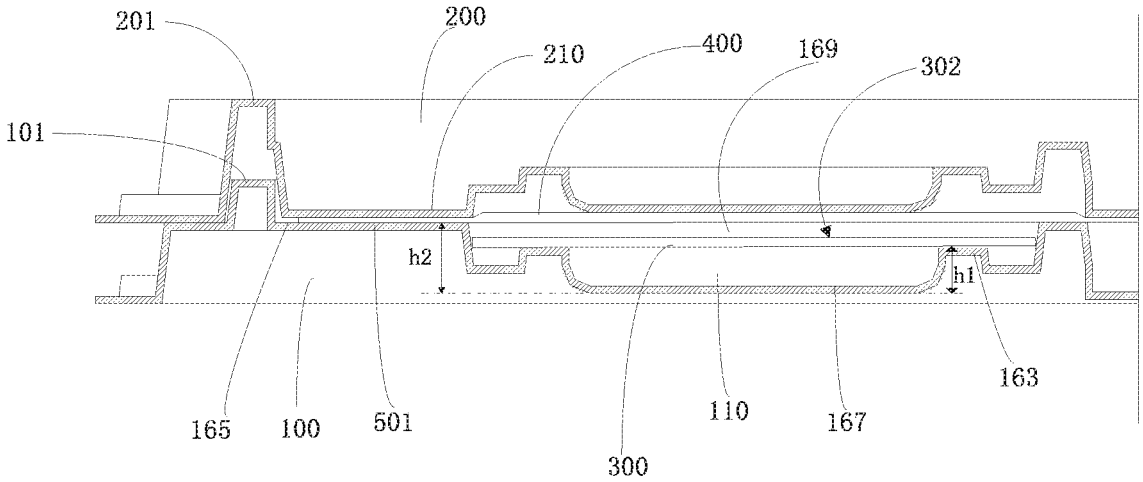
FIG. 3 shows a schematic structural diagram of a cross-section of a packaging tray structure when packaging a substrate according to an embodiment of the present disclosure.

As shown in FIG. 1 to FIG. 3, in an alternative embodiment according to the present disclosure, a first supporting surface 163 for supporting the to-be-packaged object 300 is provided in the recess 110; the limiting portion includes a supporting platform 501 formed on the first surface 161 of the first tray 100 and surrounding the recess 110, the supporting platform 501 having a second supporting surface 165 for supporting the protective gasket 400, wherein the first supporting surface has a first height h1 in a direction perpendicular to a recess bottom 167 of the recess 110, the second supporting surface 165 has a second height h2 in the direction perpendicular to the recess bottom 167 of the recess 110, the second height h2 is greater than the first height h1, and a difference between the second height h2 and the first height h1 is a preset value.

In the above manner, the limiting portion is formed as the support platform 501 surrounding the periphery of the recess 110. The second supporting surface 165 on the support platform 501 for supporting the protective gasket 400 is higher than the first supporting surface 163 in the recess 110 for supporting the to-be-packaged object 300 by the preset value, so that a preset gap 169 can be maintained between the protective gasket 400 and the to-be-packaged object 300. This structure is concise and since the support platform 501 may be formed integrally with the main body (i.e., a portion other than the support platform 501) of the first tray 100, the manufacturing process is simple.

It should be noted that, in practical applications, the limiting portion may also be implemented by other structures. For example, a fixing structure capable of fixing the protective gasket 400 may be disposed on the second tray 200. The disclosure is not specifically limited thereto.

It should also be noted that in the above manner, optionally, the preset value is greater than or equal to the sum of the thickness of the to-be-packaged object 300 and the width of the preset gap 169, where the width of the preset gap 169 ranges from 1 mm to 2 mm. Here, the thickness of the to-be-packaged object 300 refers to a dimension of the to-be-packaged object 300 in a vertical direction when the packaging tray structure is in the position shown in FIG. 3; and the width of the gap 169 refers to a dimension of the gap 169 in the vertical direction when the packaging tray structure is in the position shown in FIG. 3.

In the above manner, the preset gap 169 of 1 mm to 2 mm can be maintained between the to-be-packaged object 300 and the protective gasket 400. As such, the to-be-packaged object 300 can be prevented from the damage while the to-be-packaged object 300 can be protected effectively.

Optionally, the protective gasket 400 is about 1.4 mm higher above a surface 302 of the to-be-packaged object 300. That is, the width of the preset gap 169 is 1.4 mm. Of course, it can be understood that the specific value of the preset gap 169 may also be adjusted as required. For example, the preset gap 169 may also be 1 mm, 1.5 mm, 2 mm and any other suitable values.

In addition, as shown in FIG. 1 to FIG. 4, in the embodiment according to the disclosure, optionally, a plurality of recesses 110 are formed on the first surface 161 of the first tray 100, and the protective gasket 400 is an integral sheet-like structure capable of covering all the recesses 110. The limiting portion is disposed on the periphery of each of the recesses 110.

In the above manner, a plurality of to-be-packaged objects 300 may be accommodated and packed in one single packaging tray structure at the same time, and the protective gasket 400 is formed as the integral structure. The limiting portion may be disposed on the periphery of each of the recesses 110 to support and limit the protective gasket 400 in place, such that the preset gap is retained between the to-be-packaged object 300 in each recess 110 and the protective gasket 400.

Of course, it can be understood that only one of optional structures is provided above. In practical applications, the number of the recesses 110, the number of the protective gaskets 400, and the specific position of limiting portions can be adjusted as required and are not restricted herein.

In addition, since the protective gasket 400 is usually made of a foam material, which is relatively soft and has a certain self-weight, certain parts thereof may naturally droop under the action of gravity to come into contact with the to-be-packaged object 300. In order to address the above problem, in the embodiment according to the disclosure, optionally, a fixing portion for fixing the protective gasket 400 may be further provided between the first tray 100 and the second tray 200 to avoid the deformation of the protective gasket 400 due to its own weight.

In the above manner, the protective gasket 400 is partially fixed by the fixing portion, so as to avoid the deformation of the protective gasket 400 due to its own weight.

The fixing portion can be implemented in various ways. In the following, two alternative embodiments of the fixing portion are provided.

FIGS. 1 to 3 illustrate schematic structural diagrams of an embodiment of the packaging tray according to the disclosure. As shown in FIGS. 1 to 3, in the embodiment according to the disclosure, the second tray 200 includes a second surface 171 facing the first tray 100. The fixing portion includes a raised pressure platform 210 protruding from the second surface 171. The raised pressure platform 210 is provided in a position corresponding to the periphery of the recess 110, so as to press and fix the protective gasket 400 against the first tray 100.

In the above manner, a sinking process can be performed on the surface of the second tray 200 facing the first tray 100 (i.e., the second surface 171), while the raised pressure platform 210 is formed at the position corresponding to the periphery of the recess 110. The raised pressure platform 210 can press the protective gasket 400 onto the first tray 100. As shown in FIG. 3, since the raised pressure platform 210 on the second tray 200 presses against some portions of the protective gasket 400, the pressure received by the protective gasket 400 can counteract the sinking deformation of protective gasket 400 caused by its own weight.

It should be noted that the shape, size and position of the raised pressure platform 210 can be designed according to the actual structure of the second tray 200, which are not specifically restricted herein.

Figure 4:
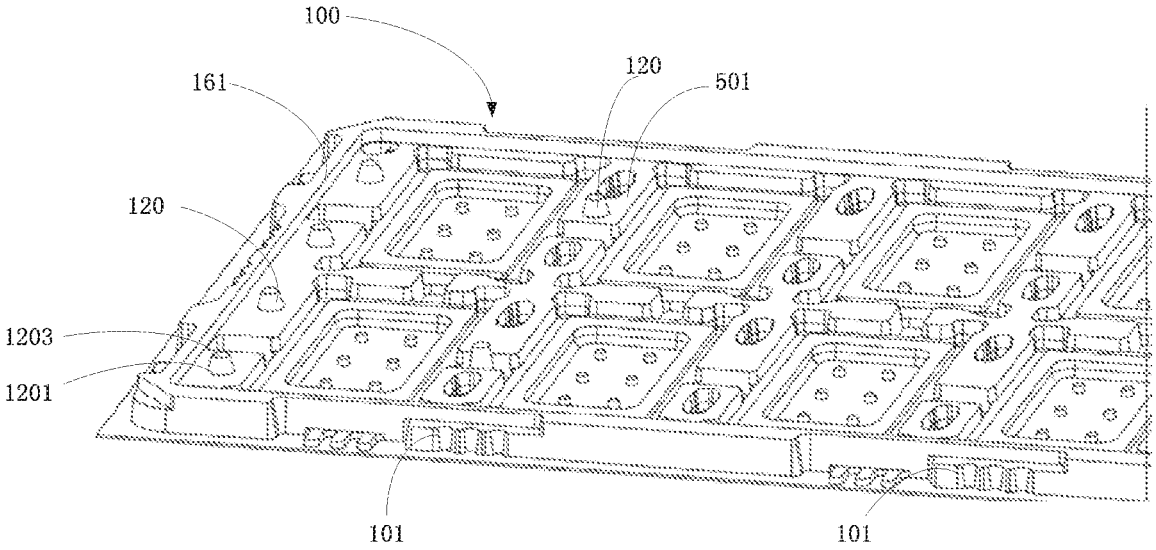
FIG. 4 shows a schematic structural diagram of a first tray of a packaging tray structure according to an embodiment of the present disclosure.
Figure 6:
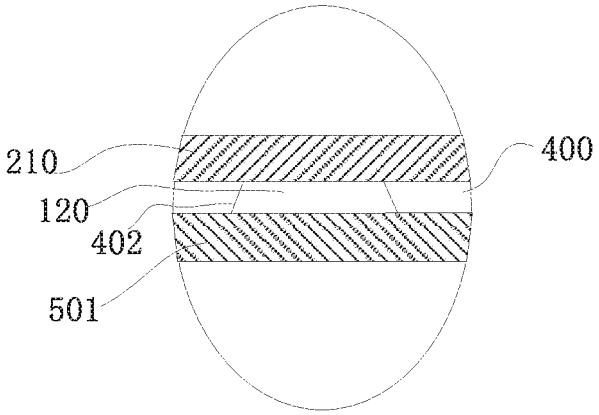
FIG. 6 is a schematic enlarged diagram of the portion VI as indicated in circle in FIG. 5.

FIG. 4 is a schematic structural diagram of an embodiment of the packaging tray according to the disclosure. As shown in FIG. 4, in an optional embodiment according to the disclosure, the protective gasket 400 is provided with a plurality of openings 402 (as shown in FIG. 6) in a region corresponding to the periphery of the recess 110. The fixing portion includes a plurality of fixing columns 120 that can pass through the openings 402. The fixing columns 120 protrude from the first surface 161 of the first tray 100, on the periphery of the recess 110 corresponding to the positions of the openings 402.

Figure 5:
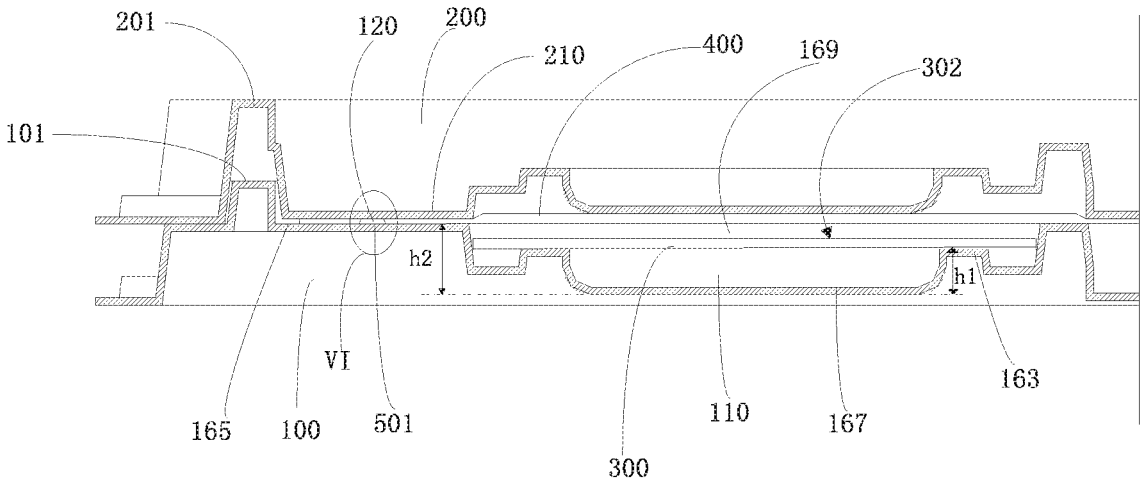
FIG. 5 shows a schematic structural diagram of a cross-section of a packaging tray structure when packaging a substrate according to an embodiment of the present disclosure.

In the above manner, the plurality of fixing columns 120 are provided on the periphery of the recess 110 on the side of the first tray 100 facing the second tray 200 (i.e., on the first surface 161), while the openings 402 are formed in the protective gasket 400. As shown in FIG. 5 and FIG. 6, the fixing columns 120 may pass through the openings 402 formed in the protective gasket 400 to fix the protective gasket 400. Such a fixation force undergone by the protective gasket 400 can counteract the sinking deformation of the protective gasket 400 caused by its own weight.

It should be noted that, the shape, size and position of the fixing columns 120 can be designed according to the actual structure of the first tray 100, which are not specifically restricted herein.

Optionally, as shown in FIG. 4, the fixing column 120 includes a first end 1201 connected to the first tray 100 and a second end 1203 opposite to the first end 1201, wherein the outer diameter of the fixing column 120 gradually decreases from the first end 1201 to the second end 1203. In the above manner, the top end (i.e., the second end 1203) of the fixing column 120 is thin and the bottom end (i.e., the first end 1201) is thick. Since the opening 402 in the protective gasket 400 can encompass the fixing column 120, when the size of the preset gap between the protective gasket 400 and the to-be-packaged object 300 needs to be adjusted, it can be adjusted by controlling the size of the opening 402 in the protective gasket 400. In this manner, the first tray 100 can be used to carry to-be-packaged objects 300 having different thickness and meet different requirements on the preset gap, so that the versatility of the first tray 100 can be improved and the production cost can be reduced.

In an optional embodiment according to the disclosure, as shown in FIG. 4, the cross-section of the fixing column 120 is circular. That is, the fixing column 120 is in a form of truncated conical column.

In the above manner, the fixing column 120 is in a form of truncated conical column. On one hand, this facilitates adjusting the preset gap between the to-be-packaged object 300 and the protective gasket 400. On the other hand, the fixing column 120 can be formed by performing the sinking process on the main body part of the first tray 100 at relevant portions thereof with a simple structure and an easy process.

Of course, it can be understood that in practical applications, the fixing column 120 may also be a truncated triangular pyramid with a triangular cross section or a truncated rectangular pyramid with a square cross section, or may be any other shapes which are no longer enumerated one by one herein.

In addition, it should also be noted that in the packaging tray structure according to the disclosure, the first tray 100 further includes a first concave-convex structure 101 for cooperating with the second tray 200, and the second tray 200 further includes a second concave-convex structure 201 for cooperating with the first concave-convex structure 101 on the first tray 100. The cooperation of the first concave-convex structure 101 with the second concave-convex structure 201 can cause the first tray 100 and the second tray 200 to snap-fit together.

It should also be noted that the first concave-convex structure 101 and the second concave-convex structure 201 can also enable any one packaging tray structure to be stacked with another packaging tray structure. Optionally, any one the packaging tray structure can be configured to be reversely stacked with another package tray structure placed thereon. That is, the second tray 200 of any one package tray can be stacked with the first tray 100 of another package tray structure placed thereon, and the two packaging tray structures are placed in an opposite direction (i.e., rotated by 180° horizontally).

In addition, it should be noted that the packaging tray structure according to the disclosure can be used to package a display substrate.

In an embodiment of the disclosure, there is also provided a substrate packaging structure, for example, comprising the packaging tray structure and the protective gasket 400 as set forth above, wherein the to-be-packaged object 300 is a substrate, as shown in FIG. 3.

Above described are only optional implementations of the disclosure. It should be noted that one ordinary person skilled in the art may make various improvements and replacements without departing from the technical principles of the disclosure. These improvements and replacements should also be constructed as falling within the protection scope of the disclosure.

The invention claimed is:

1. A tray structure, comprising:

a first tray including a first surface and a recess formed on the first surface for placing a to-be-packaged object;

a second tray stacked on the first surface and cooperating with the first tray; and a limiting portion provided on at least one of the first tray and the second tray, for limiting shift of a protective gasket, wherein the limiting portion is configured to support the protective gasket in such a manner that the protecting gasket covers the recess and a gap is maintained between the protective gasket and the to-be-packaged object.

2. The tray structure according to claim 1, wherein, the recess has a first supporting surface for supporting the to-be-packaged object therein; and the limiting portion comprises a supporting platform disposed on the first surface of the first tray, and the supporting platform is configured to surround the recess and has a second supporting surface for supporting the protective gasket, wherein the first supporting surface has a first height in a direction perpendicular to a bottom of the recess, the second supporting surface has a second height in the direction perpendicular to the bottom of the recess, and the second height is greater than the first height.

3. The tray structure according to claim 2, wherein, a difference between the second height and the first height is greater than or equal to a sum of a thickness of the to-be-packaged object and a width of the gap.

4. The tray structure according to claim 3, wherein the width of the gap ranges from 1 mm to 2 mm.

5. The tray structure according to claim 1, further comprising a fixing portion provided between the first tray and the second tray to fix the protective gasket.

6. The tray structure according to claim 5, wherein, the second tray includes a second surface facing the first tray; and the fixing portion includes a raised pressure platform protruding from the second surface, the raised pressure platform being disposed in a position corresponding to the periphery of the recess so as to press and fix the protective gasket against the first tray.

7. The tray structure according to claim 5, wherein, the protective gasket is provided with a plurality of openings in a region corresponding to the periphery of the recess; and the fixing portion includes a plurality of fixing columns protruding from the first surface of the first tray and inserted into the openings.

8. The tray structure according to claim 7, wherein, the fixing column includes a first end connected to the first tray and a second end opposite to the first end, wherein an outer diameter of the fixing column gradually decreases from the first end to the second end.

9. The tray structure according to claim 8, wherein, the fixing column has a cross section in a circular, triangular or square shape.

10. The tray structure according to claim 1, wherein, a plurality of recesses are formed on the first surface of the first tray, the protective gasket is an integral sheet covering all the recesses, and the limiting portion is disposed on the periphery of each of the recesses.

11. A packaging structure, comprising the tray structure according to claim 1, wherein the protective gasket is disposed between the first tray and the second tray.

12. A packaging structure for packaging a substrate, comprising:

a tray structure for packaging the substrate, wherein the tray structure comprises:

a first tray including a first surface and a recess formed on the first surface for placing a to-be-packaged object, the to-be-packaged object being considered as the substrate;

a second tray facing the first surface and cooperating with the first tray;

a protective gasket disposed between the first tray and the second tray; and a limiting portion provided on at least one of the first tray and the second tray, for limiting shift of protective gasket, wherein the limiting portion supports the protective gasket in such a manner that the protective gasket covers the recess and a gap is maintained between the protective gasket and the to-be-packaged object.

13. The packaging structure according to claim 12, wherein, the recess has a first supporting surface for supporting the to-be-packaged object therein; and the limiting portion comprises a supporting platform which is disposed on the first surface of the first tray and surrounds the recess and which has a second supporting surface for supporting the protective gasket, wherein the first supporting surface has a first height in a direction perpendicular to a bottom of the recess, the second supporting surface has a second height in the direction perpendicular to the bottom of the recess, and the second height is greater than the first height.

14. The packaging structure according to claim 13, wherein, a difference between the second height and the first height is greater than or equal to a sum of a thickness of the to-be-packaged object and a width of the gap.

15. The packaging structure according to claim 14, wherein the width of the gap ranges from 1 mm to 2 mm.

16. The packaging structure according to claim 12, wherein the packaging tray structure further comprises a fixing portion provided between the first tray and the second tray to fix the protective gasket.

17. The packaging structure according to claim 16, wherein, the second tray includes a second surface facing the first tray; and the fixing portion includes a raised pressure platform protruding from the second surface, the raised pressure platform being disposed in a position corresponding to the periphery of the recess so as to press and fix the protective gasket against the first tray.

18. The packaging structure according to claim 16, wherein, the protective gasket is provided with a plurality of openings in a region corresponding to the periphery of the recess; and the fixing portion includes a plurality of fixing columns protruding from the first surface of the first tray and inserted into the openings.

19. The packaging structure according to claim 18, wherein, the fixing column includes a first end connected to the first tray and a second end opposite to the first end, wherein an outer diameter of the fixing column gradually decreases from the first end to the second end.

20. The packaging structure according to claim 12, wherein, a plurality of recesses are formed on the first surface of the first tray, the protective gasket is an integral sheet-like structure covering all the recesses, and the limiting portion is disposed on the periphery of each of the recesses.

* * * * *